US009364040B2

(12) United States Patent
Saladino

(10) Patent No.: US 9,364,040 B2
(45) Date of Patent: Jun. 14, 2016

(54) HEADWEAR WITH STORABLE ACCESSORY

(76) Inventor: Gregory Saladino, Cardiff by the Sea, CA (US)

( * ) Notice: Subject to any disclaimer, the term of this patent is extended or adjusted under 35 U.S.C. 154(b) by 955 days.

(21) Appl. No.: 13/507,389

(22) Filed: Jun. 25, 2012

(65) Prior Publication Data

US 2013/0340142 A1 Dec. 26, 2013

(51) Int. Cl.
*A42B 1/24* (2006.01)
*A42B 3/18* (2006.01)

(52) U.S. Cl.
CPC ..... *A42B 1/241* (2013.01); *A42B 1/247* (2013.01); *A42B 3/185* (2013.01)

(58) Field of Classification Search
CPC ..... A42B 1/241; A42B 1/24; A42B 3/04
See application file for complete search history.

(56) References Cited

U.S. PATENT DOCUMENTS

| | | | | |
|---|---|---|---|---|
| 2,615,168 | A * | 10/1952 | Springer et al. | 2/195.2 |
| 3,750,192 | A * | 8/1973 | Beresic | 2/422 |
| 3,765,031 | A * | 10/1973 | Beresic | 2/422 |
| RE30,899 | E * | 4/1982 | Kallman | 24/3.3 |
| 5,105,475 | A | 4/1992 | Lynd et al. | |
| 5,539,929 | A * | 7/1996 | Revson | 2/195.1 |
| 5,815,832 | A | 10/1998 | Skolik | |
| 5,860,165 | A * | 1/1999 | Cvijanovich | 2/195.1 |
| 5,894,604 | A * | 4/1999 | Crabb et al. | 2/209.13 |
| 5,926,854 | A | 7/1999 | Grilliot et al. | |
| 5,933,871 | A * | 8/1999 | Kraft | 2/209.13 |
| 6,170,087 | B1 * | 1/2001 | Brannon | 2/209.13 |
| 7,240,372 | B2 * | 7/2007 | Larson | 2/173 |
| 7,260,850 | B2 | 8/2007 | Ambuske et al. | |
| 7,690,052 | B2 | 4/2010 | Saladino | |
| 8,001,624 | B1 | 8/2011 | Leedom | |
| 2006/0117450 | A1 | 6/2006 | Matsumoto | |
| 2008/0250538 | A1 | 10/2008 | Saladino | |
| 2009/0210995 | A1 | 8/2009 | Kwon et al. | |
| 2011/0185482 | A1 | 8/2011 | Godfrey et al. | |

(Continued)

FOREIGN PATENT DOCUMENTS

KR 20-0239252 Y1 10/2001

OTHER PUBLICATIONS

Frostline Hat™. Style# 82045OR. Website: http://www.outdoor-research.com/en/frostline-hat.htm. [Retrieved Oct. 2, 2014].

(Continued)

*Primary Examiner* — Shaun R Hurley
*Assistant Examiner* — Andrew W Sutton
(74) *Attorney, Agent, or Firm* — Mintz Levin Cohn Ferris Glovsky and Popeo, P.C.

(57) ABSTRACT

Headwear in which a storage area or pocket is formed in one side of the hat portion where an accessory is stored in the pocket when not in use. The free end of the accessory can be removed from the pocket by the wearer and pulled across the wearer's face after which the free end of the accessory is detachably secured to an opposite side of the hat portion so that the accessory remains positioned over the wearer's face. After use, the free end of the accessory is detached from the hat portion and returned for storage in the pocket. The invention is described in an embodiment for use in a ski hat in which the accessory is a goggle. Also described is the provision of a non-permeable layer in the hat portion that prevents moisture from reaching the goggle to prevent it from fogging up during its use.

24 Claims, 9 Drawing Sheets

(56) References Cited

U.S. PATENT DOCUMENTS

| | | | | |
|---|---|---|---|---|
| 2011/0252547 | A1 | 10/2011 | Leung et al. | |
| 2012/0060259 | A1 * | 3/2012 | Falken | A42B 1/241 2/209.13 |

OTHER PUBLICATIONS

International Search Report issued in International Application No. PCT/US2013/047160, mailed Oct. 4, 2013.

* cited by examiner

HEADWEAR WITH STORABLE ACCESSORY

FIELD OF THE INVENTION

The present invention relates generally to headwear, and more particularly to an article of headwear such as a cap, hat, hood or helmet, and an accessory, such as a goggle or bandanna, stored in the headwear and selectively moved into a position over the wearer's face.

BACKGROUND OF THE INVENTION

During the performance of many activities, such as skiing and riding a motorcycle, an individual wears an item of headgear, such as a ski hat or helmet, while also using an accessory, such as a pair of ski goggles or a bandanna to protect his face while he is engaged in the activity. For example, it is common for a skier to place the goggle over his eyes and face during a ski run to protect them from wind and the glare of the sun, particularly as it is reflected from the white snow.

It is a common practice for the skier to initially position the goggle over the forehead so that it rests on the front of the ski hat. The goggle is held in place by an elastic strap wrapped around the head. When he wishes to protect his face from snow and wind, the skier grasps the goggle, usually with both hands, and pulls it over his eyes.

In my recently issued U.S. Pat. No. 7,690,052, I describe how a goggle band may be securely retained to the upper or forehead portion of a ski hat in order to prevent the goggle from being separated from the hat. The goggle can be pivoted downward to cover the wearer's eyes and face, when desired, and be raised back to its original position at the conclusion of the activity (e.g. skiing). Other prior hat constructions that include a face-covering accessory are disclosed in U.S. Pat. No. 7,260,850 to Ambuske et al; U.S. Pat. No. 5,815,832 to Skolik; US Pub. 2011/0185482 to Godfrey; Pub. No. 2006/0117450 to Matsumoto; and U.S. Pat. No. 5,105,475 to Lynd et al.

It has been found, in my patented and other known headwear-protective-accessory designs, that it is sometimes difficult and unwieldy for the wearer of the headwear to manipulate the accessory (e.g. goggle) to its lower, covering, protective position, and to achieve a tight, snug fit of the goggle over the wearer's eyes when the goggle is in its face-covering position. The same problems arise when a bandanna or the like, rather than a goggle, is used as an accessory.

Another problem that often arises when a conventional ski hat and goggle are employed is that when the goggle is not in use and is raised away from the eyes and rests on the front portion of the wearer's hat, heat and moisture from the wearer's forehead may pass through the porous material of the hat and reach the goggle's inner surface and thereby fog up the goggle. When the goggle is later lowered over the wearer's eyes the mist or fog previously formed on the goggle's inner surface will reduce significantly the wearer's ability to see and thus create a potentially dangerous condition.

OBJECTS OF THE INVENTION

It is therefore an object of the present invention to provide an item of headwear and an associated accessory in which the accessory can be readily placed in position for use when desired and returned to its original, stored position after its use.

It is another object of the invention to provide an item of headwear as described, in which the accessory may be easily adjusted over the wearer's face so as to achieve an improved fit and snugness.

It is yet a further object of the invention to provide an item of headwear as described in which the accessory is securely retained in the headwear when not in use in a manner that does not materially change the overall appearance of the headwear.

It is yet a further object of the invention to provide an item of headwear in which fogging of an eyewear lens or goggle during use is substantially prevented.

SUMMARY OF THE INVENTION

To these ends, the present invention is directed to an item of headwear and an accessory in which an accessory-storage area or pocket is provided on one side of the hat and in which the accessory is stored when it is not in use. When it is desired to deploy the accessory for use in protecting the wearer's face, the wearer grasps the free end of the accessory, pulls it out and away from its stored position and across his face, and then detachably secures the free end of the accessory to the opposite side of the hat. The wearer may adjust the tightness and fit of the accessory to optimally conform it to the size and shape of his face.

The accessory used with the headwear of the invention may be a goggle band, ski goggle, or bandanna. The accessory may be used, for example, in conjunction with the hood of a hooded sweatshirt, the hood of a jacket, a hat, a cap or a helmet.

In another aspect of the present invention, the headwear may include a non-permeable layer to prevent heat and moisture from the wearer from passing onto the lens of the adjacent goggle when it is in its rest or stored position, so that the lens is not fogged and the wearer's vision is not impaired when the goggle is in place over the wearer's eyes.

BRIEF DESCRIPTION OF THE DRAWINGS

To the accomplishment of the above and to such further objects as may hereinafter appear, the present invention relates to an article of headwear and an associated accessory, substantially as defined in the appended claims and as described in the following specification of several embodiments as considered in conjunction with the accompanying drawings, in which:

DETAILED DESCRIPTION OF THE PREFERRED EMBODIMENTS

Figure 1:
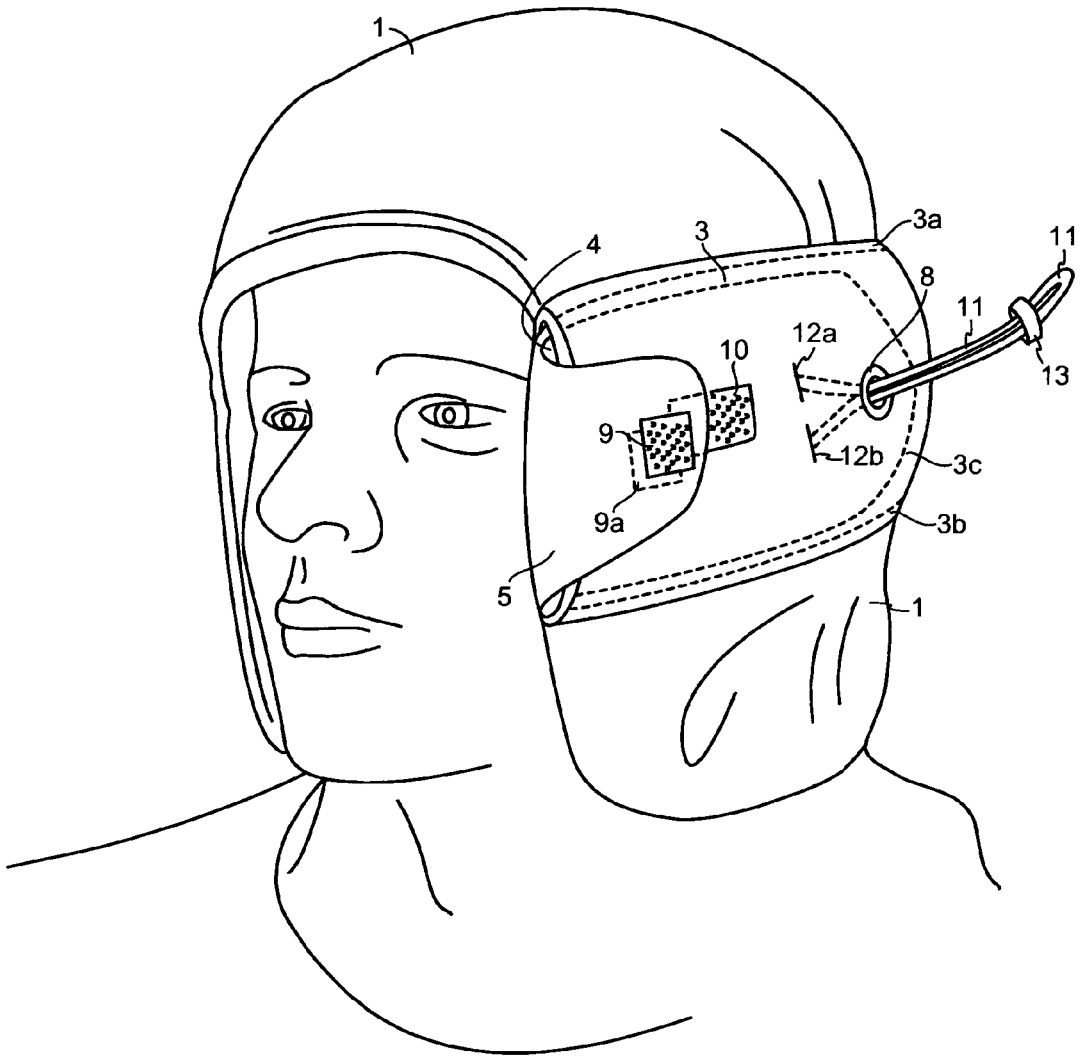
FIGS. 1-4 are side elevations illustrating a hat and goggle arrangement in accordance with a first embodiment of the invention.

Referring now to the drawings, there is shown in FIGS. 1-4 a first embodiment of the present invention as it used with an article of headwear or a hat 1 and a goggle band 5 (not shown in FIG. 1). A material 3 is affixed to one side of hat 1 as by upper and lower horizontal stitches 3*a* and 3*b*, which form an opening or pocket 4. The rear edge 3*c* of pocket 4 may be left open or sewn closed. Material 3 may be made of neoprene, foam, canvas, cotton, flannel, plastic, or a thermoformed plastic. A male Velcro® (hook and loop fabric) tab 10 is placed on the outer surface of material 3 toward the front of the wearer's face. Pocket 4 may be situated in a horizontal position, or it may be angled upward toward the top of the head or downward toward the wearer's neck. The pocket may also be located toward the rear of the hat or situated on the inside of the hat, or positioned in between an internal and external lining of a dual-layered hat.

Figure 2:
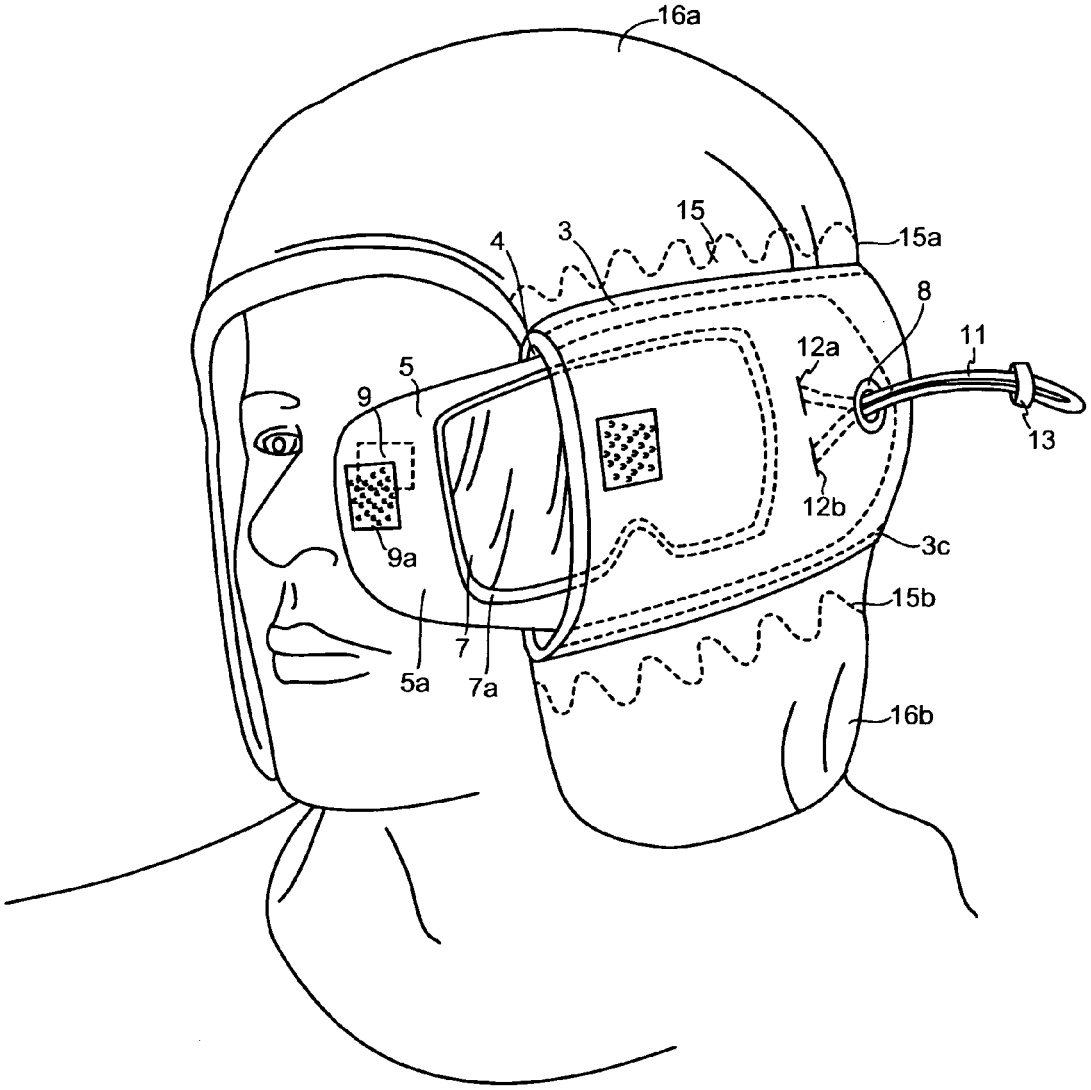

As can be seen in FIG. 2, the goggle band 5 is normally, that is, when not deployed by the wearer, stored in pocket 4. A retention string 11 is attached to the inner end of the goggle band 5 at a contact point 12*a*. String 11 extends out of pocket 4 through a grommet 8 on material 3. The string 11 then passes through a chord lock 13, makes a loop, passes back through chord lock 13, reenters pocket 4 through grommet 8, and is reattached to the inner end of goggle band 5 at contact point 12*b*.

The other, free end of the goggle band 5 protrudes out from the pocket 4 toward the front end of the hat and is folded back on itself and attached to material 3 by means of a female Velcro® (hook and loop fabric) tab 9*a* attached to the underside of the free end of the goggle band. When the goggle band 5 is in the position shown in FIG. 2, stored within pocket 4, the exposed Velcro® (hook and loop fabric) tab 9 is not in use. Other separably detachable elements, such as a buttons and slits, hooks and loops, latches, closure mechanisms, button snaps, snap grommets, or magnets with metal connecting tabs may be used in place of the Velcro® (hook and loop fabric) tabs 9, 9*a*.

When the wearer wishes to cover his eyes with the goggle, such as a skier about to descend a slope, he grabs the free end of goggle band 5 with one hand, thereby separating Velcro® (hook and loop fabric) tab 9*a* from Velcro® (hook and loop fabric) tab 10 and allowing him to pull the goggle band 5 out of pocket 4. As the wearer continues to pull the goggle band 5 out of the pocket, the goggle band unfolds so that it comes to rest partially in front of the wearer's face, exposing the most forward position of goggle lens 7, which is embedded into the goggle band by means of a plastic or rubber encasement 7*a*.

Figure 3:
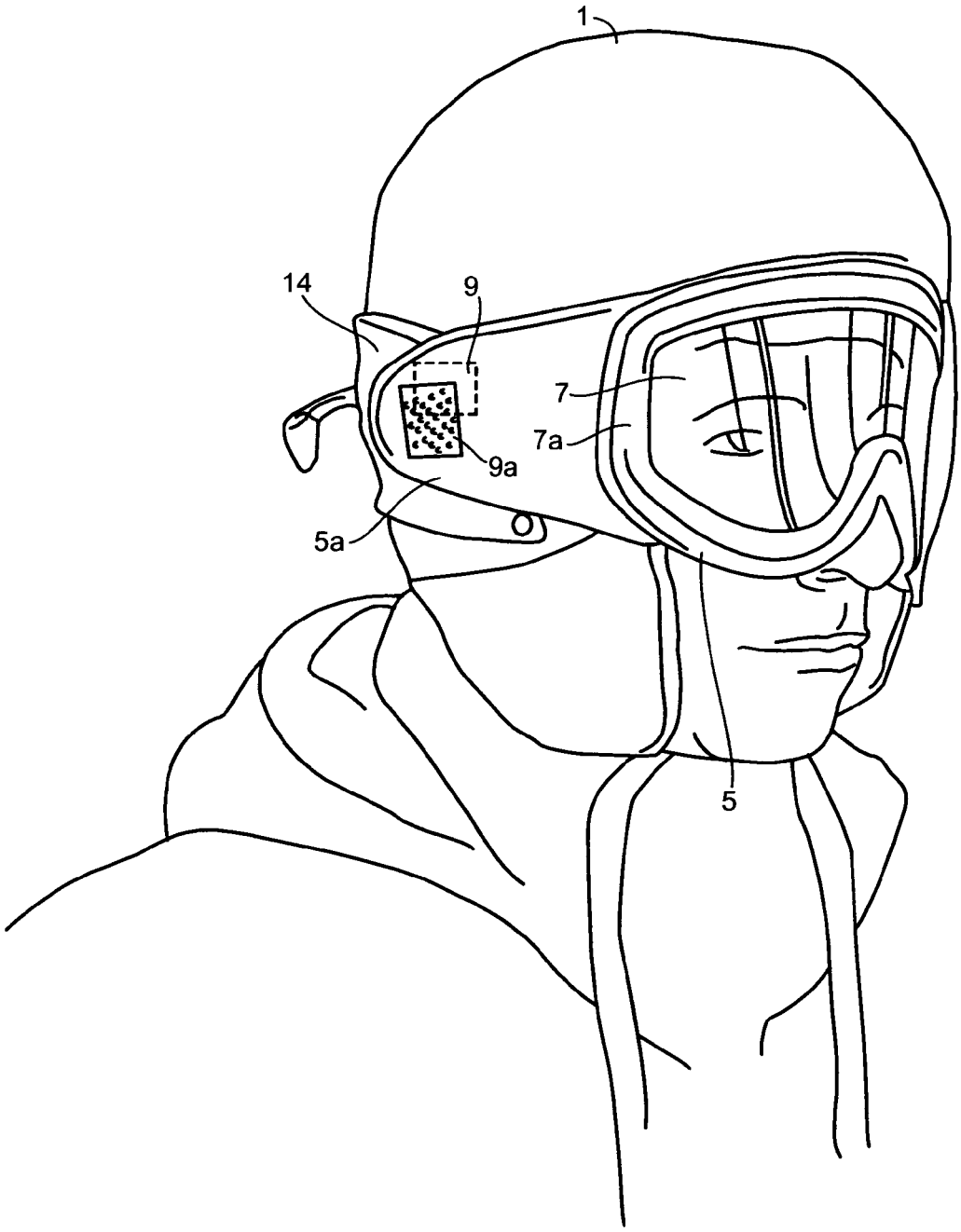

The wearer proceeds by continuing to pull the free end 5*a* of goggle band 5 outward and away from his face, and then wraps it horizontally across his face and attaches its free end to the opposite side of the hat as is shown best in FIG. 3. The free end of the goggle band is separably or detachably secured to the opposite side of hat 1 by means of male Velcro® (hook and loop fabric) tab 9 attached to the underside of goggle band 5 mating with the female Velcro® (hook and loop fabric) tab 14 affixed to the opposite side of the hat. If the wearer desires a tighter fit of the goggle band, he may place Velcro® (hook and loop fabric) tab 9 further to the rear of Velcro® (hook and loop fabric) tab 14. If he desires a looser fit of the goggle band, he may position Velcro® (hook and loop fabric) tab 9 at a more forward position of tab 14.

Figure 4:
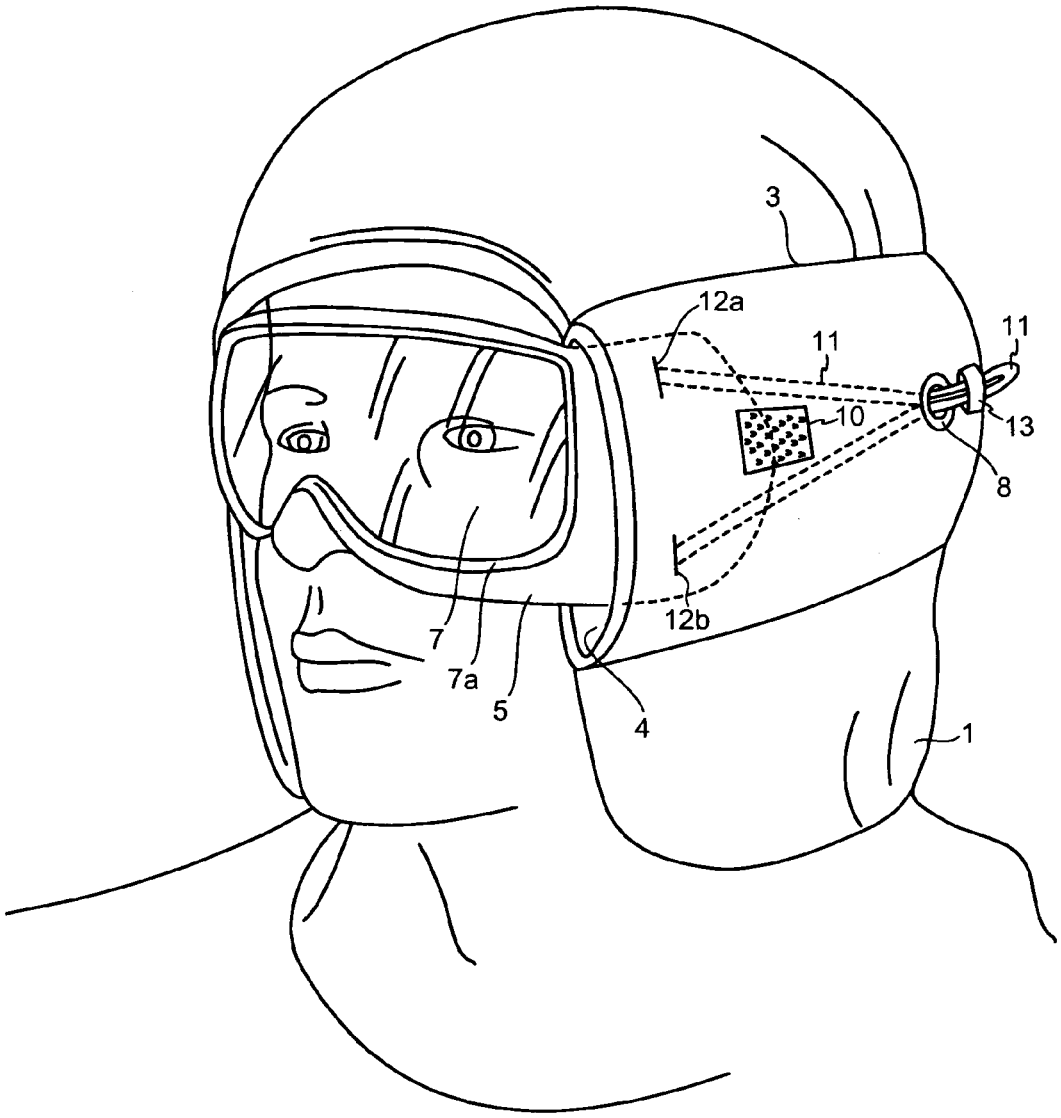

As can be seen in FIG. 4, the goggle band 5 is fully extended across the wearer's face and is separably attached at its free end 5*a* to the opposite side of hat 1. String 11 has been extended inward toward the front of pocket 4 and chord lock 13 acts as a stopper preventing string 11 from being pulled any further through the grommet opening 8, thereby preventing goggle band 5 from falling out of the pocket. Even in its fully extended position shown in FIG. 4, a part of the goggle band is retained within pocket 4.

It is also possible that pocket 4 and Velcro® (hook and loop fabric) tab 14 be separably attached to hat 1 by Velcro® (hook and loop fabric) or other known attaching means, If the goggle band is to be used with an open-faced helmet, the underside of pocket 4 and tab 14 may be coated with an adhesive. The wearer would peel off a protective backing and place the pocket and Velcro® (hook and loop fabric) tab on the outer surface of the helmet.

If the wearer desires a yet tighter fit of the goggle band over his face, he may squeeze chord lock 13 and pull string 11 through chord lock 13, back and away from his head, thereby to pull the goggle band tighter around his face. Alternatively, the wearer may squeeze chord lock 13 while pulling goggle band 5 further out of pocket 4, which then pulls string 11 further into pocket 4, thereby allowing for additional slack in the string, which, in turn, results in a looser fit of the goggle band around the wearer's face.

To return the goggle band 5 to its original, stored position shown in FIG. 1, the wearer grabs the free end 5*a* of the goggle band 5 with one hand, and detaches Velcro® (hook and loop fabric) tab 9 from Velcro® (hook and loop fabric) tab 14. He then, with his other hand, grabs hold of string 11 by the slack that is left outside of chord lock 13, and then pulls retention string 11 out and away from his head, thereby threading string 11 outside of pocket 4 through grommet hole 8, which reactively causes goggle band 5 to be retracted into pocket 4 to its original rest position. The wearer then grabs hold of the free end 5*a* and folds it back over pocket 4, reconnecting it to Velcro® (hook and loop fabric) tab 10 by means of Velcro® (hook and loop fabric) tab 9*a*.

The wearer may either squeeze chord lock 13 and thread retention string 11 through it, as he pulls string 11 out and away from his head, or he may leave chord lock 13 in position and pull string 11 out and away from his head, thereby pulling chord lock 13 away from his head. If the latter is chosen, when goggle band 5 is back in pocket 4, the wearer may squeeze chord lock 13, and, while holding string 11, slide the chord lock 13 closer to material 3. It is also possible that excess slack of string 11 protruding out of pocket 4 may be stored in a built-in pocket. It is also possible to loop a Velcro® (hook and loop fabric) tab around string 11, and then wrap the string around the wearer's head, and separably attach it to Velcro® (hook and loop fabric) tab 14 on the opposite side of the hat.

As shown in FIG. 2, lines 15*a* and 15*b* define a non-permeable layer 15 in the same side of hat 1 on which pocket 4 and material 3 are located. Non-permeable layer 15 is formed of a material that is non-permeable to fluids such as plastic, nylon or rubber that does not permit water or moisture to freely pass therethrough. When the lens 7 of the goggle band 5 is in its stored or resting position within pocket 4 and the wearer begins to sweat during physical activity, the perspiration leaving the wearer's forehead that passes into the hat is prevented by the non-permeable layer 15 from reaching the adjacent interior surface of lens 7 so that the lens is not fogged over, thereby allowing the wearer to have a clearer, unobstructed view through the lens when it is positioned over his face.

Area 16*a*, 16*b* of hat 1 is preferably made of a breathable material such as Gore-Tex® (waterproof, breathable fabric membrane), cotton, or Primaloft® (synthetic microfiber thermal insulation material), which does allow the passage therethrough of moisture and heat. By ventilating areas 16*a* and 16*b* and not ventilating the non-permeable area 15, the wearer's head is allowed to breathe and to expel moisture through the areas 16*a* and 16*b* but not through the non-permeable layer. The non-permeable layer 15 may be sewn or attached by Velcro® (hook and loop fabric) tabs to the interior or exterior of the hat or may be secured to the hat by latches or hooks. The non-permeable layer may also be sewn in between an internal and external lining of a dual-layered hat. The non-permeable layer may also be in the form of a sprayed sealant or sprayed rubber material. This layer may also be formed by dipping the hat material into a liquid rubber, which, after drying coats the hat and creates a non-permeable layer.

Figure 5:
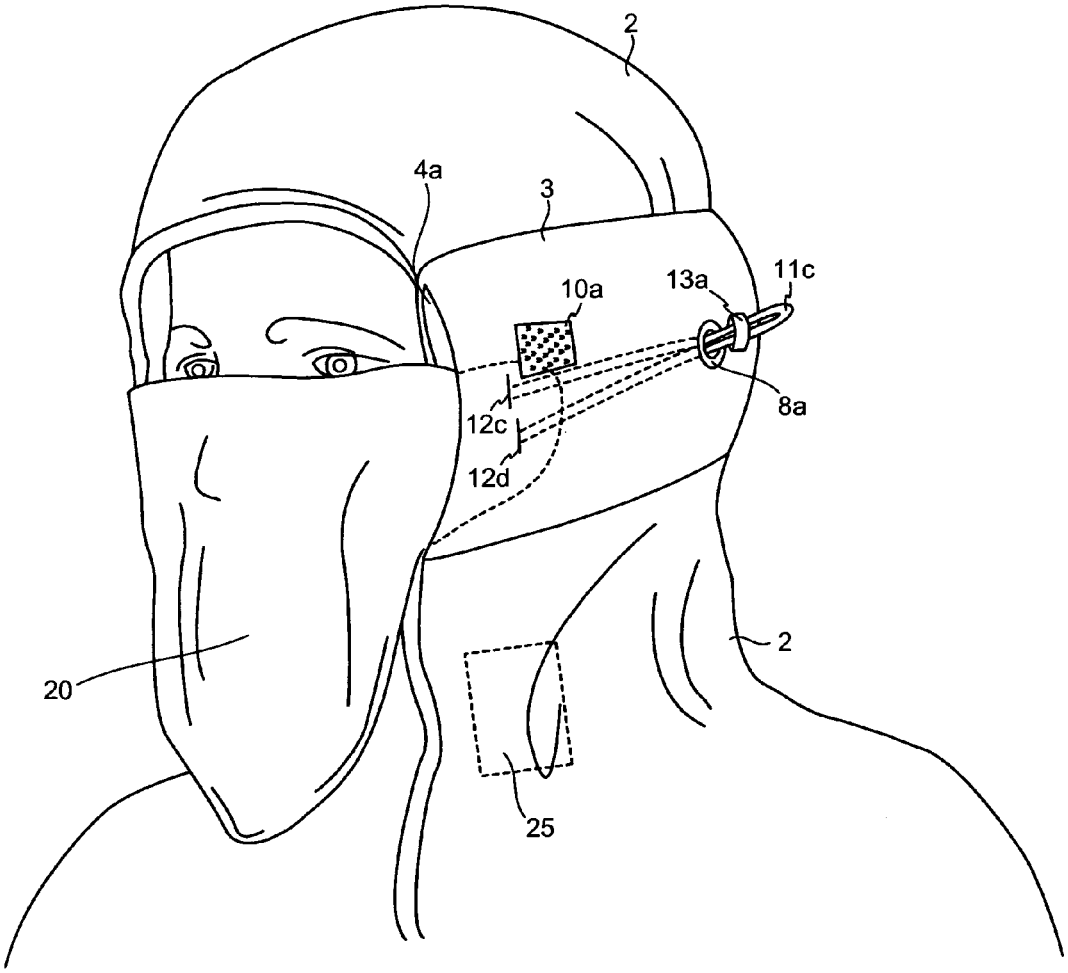
FIG. 5 illustrates a second embodiment of the invention as used in a hooded sweatshirt in which a bandanna is employed as an accessory.

The embodiment of the invention shown in FIG. 5 is similar to that shown in FIGS. 1-4 except that in place of a goggle band, a bandanna or scarf 20 is the accessory that is used in combination with a hood 2, which takes the place of the hat in the previously described embodiment. The size and shape of the bandanna are selected so that when it is deployed over the wearer's face, as seen in FIG. 5, it covers the wearer's nose, mouth, and cheeks.

A retention string 11 *c* is fully extended within pocket 4*a* formed at one side of hood 2 so that chord lock 13*a* prevents bandanna 20 from falling out of the pocket. Although not shown in FIG. 5, it will be understood that the free end of the bandanna is separably secured to the (unseen) opposite side of the hood by means of a Velcro® (hook and loop fabric) tab arrangement in manner that is similar to that described above in FIG. 3 for the goggle band. By tightening and loosening chord lock 13*a* the fit and snugness of the bandanna can be adjusted by the wearer also a previously described.

As also shown in FIG. 5, a female Velcro® (hook and loop fabric) tab 25 is attached to the internal side of hood 2. On the other side of the hood in relatively the same position, an internal male Velcro® (hook and loop fabric) tab (not shown) mates with Velcro® (hook and loop fabric) tab 25 to achieve a tighter fit of hood 2 around the neck. If desired, two pockets one housing a goggle band and the other housing a bandanna—may be provided either on one side or on opposite sides of the hood so that both of these accessories may be deployed at the same time.

Figure 6:
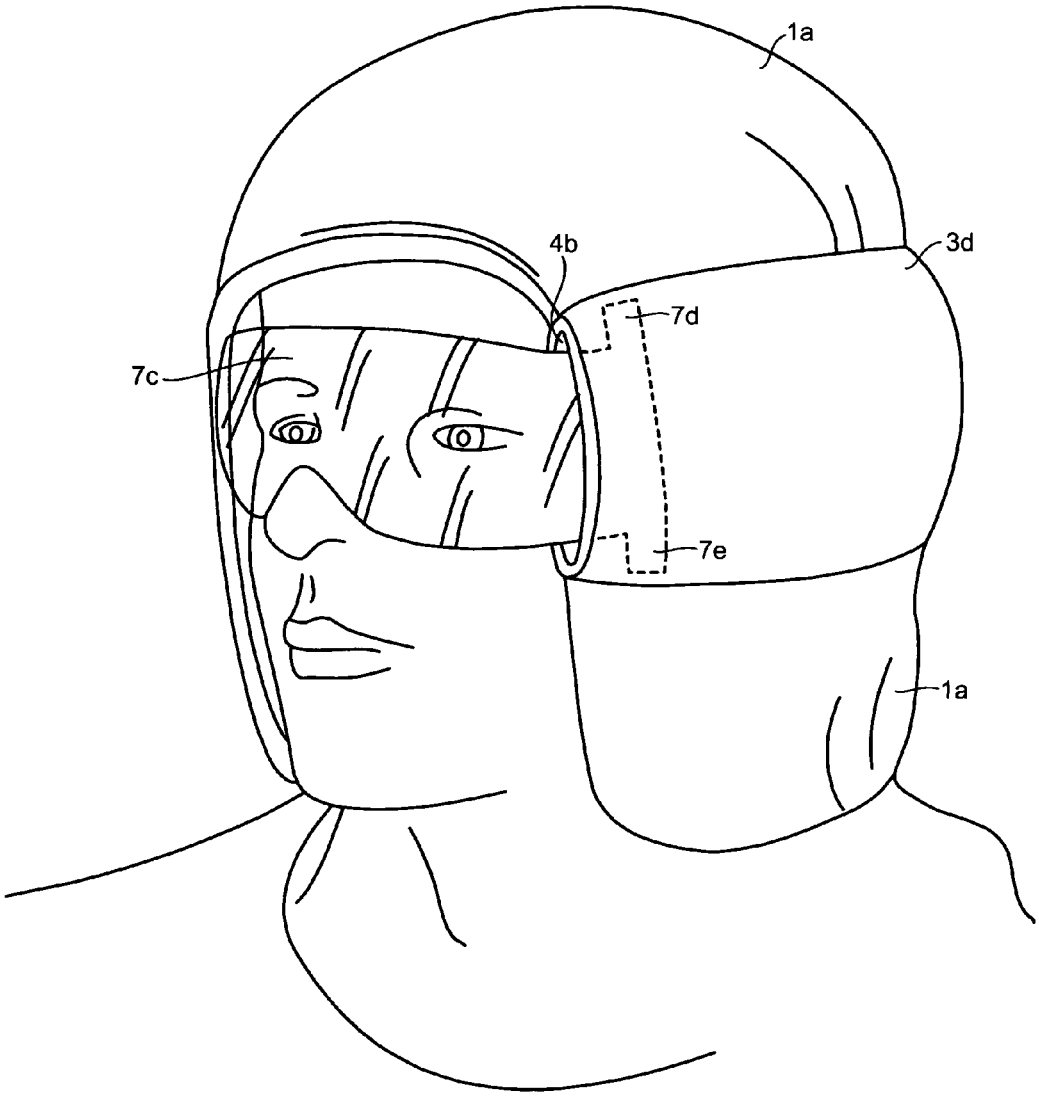
FIG. 6 illustrates a further embodiment of the invention.

In the embodiment of the invention illustrated in FIG. 6, a lens 7*c* covers the wearer's face when in use. Lens 7*c* is separably attached to the opposite side of hat 1*a* by means of a Velcro® (hook and loop fabric) connection (not shown in FIG. 6). Lens 7*c* passes through a forward opening of pocket 4*b*, which is created by material 3*d* attached to the side of the hat. When not deployed over the wearer's face, lens 7*c* is retained in place within pocket 4*b* by means of extended lens tabs 7*d* and 7*e* secured to the inner end of the lens. Tabs 7*d* and 7*e* prevent the lens from sliding out of the pocket by engaging material 3*d* at the opening 4*b* since the size of opening 4*b* is less than height of the inner portion of lens 7*c* caused by the tabs 7*d* and 7*e* that extending upward and downward from the inner portion of the lens. Tabs 7*d* and 7*e* thus play the same retention function performed by retention string 11 in the embodiment of FIGS. 1-4.

When the wearer wishes to end the use of the protective lens 7*c*, he manually releases the lens from Velcro® (hook and loop fabric) tab 14 and manually pushes it back into the storage pocket. Lens 7*c* is adjustable at this point at which it connects to Velcro® (hook and loop fabric) tab 14 at the opposite side of the hat. An adjusting device may also be added to material 3*d* or pocket 4*b* or to the allowed extension area of lens 7*c*, such as by the use of buttons or other types of closure devices on the interior of material 3*d*, that would be attached to the outer surface of the hat, inside and toward the front of pocket 4*b*. To close these connecting points would allow a shorter length of the lens to be released from the pocket, thereby allowing the lens to fit snugly over the face of a smaller person.

Figure 7:
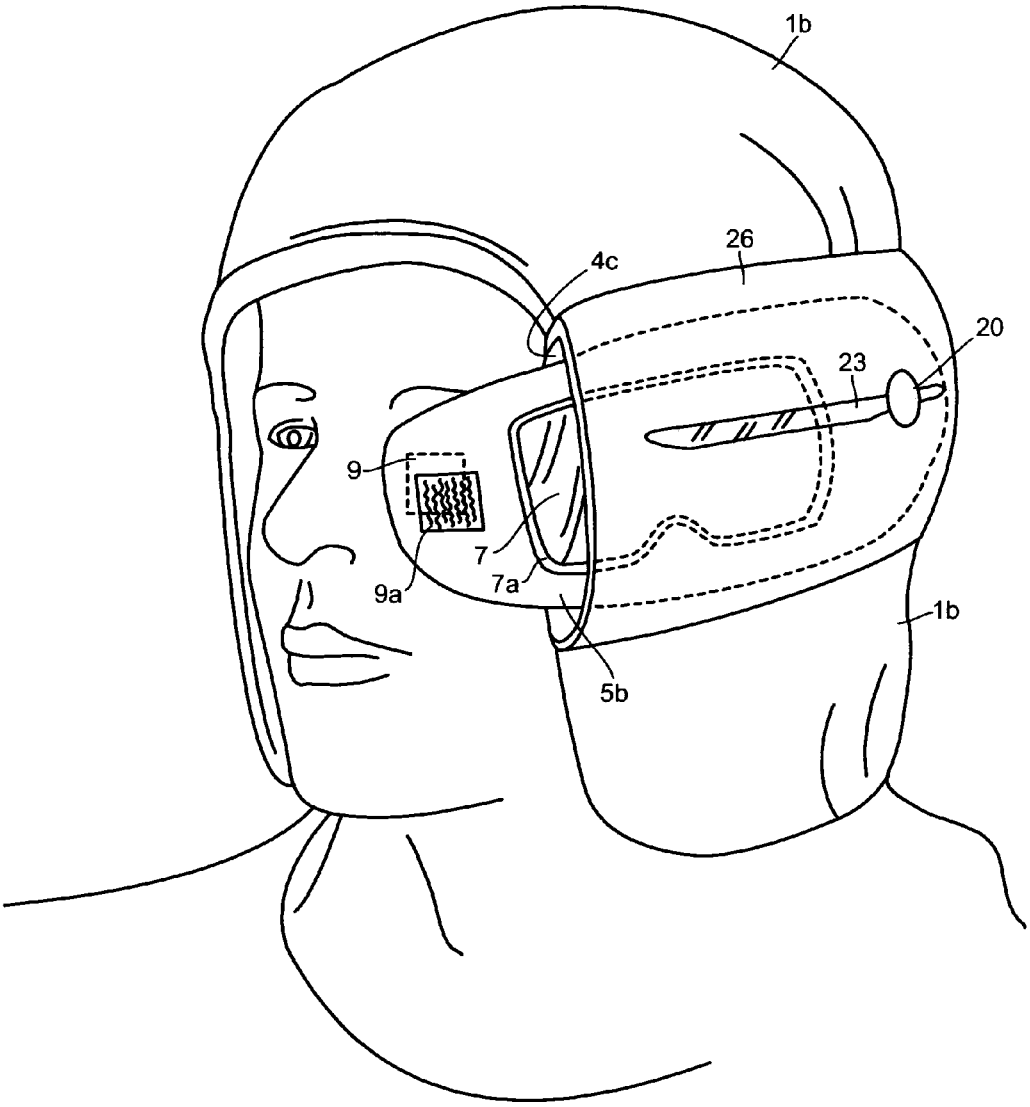
FIG. 7 illustrates another embodiment of the invention.

In the embodiment of the invention shown in FIG. 7, an encasement 26 made of plastic, neoprene, or thermoformed plastic is attached to the outer surface of the hat to create a pocket 4*c* in which a lens or goggle band 5*b* is stored. The encasement 26 is preferably convex in shape. Goggle band 5*b* is attached to hat 1*b* by a knob 20, which is inserted through a slit or track 23 to encasement 26. Track 23 allows the goggle band to slide horizontally—front to back-in pocket 4*c*

In use, the wearer grasps goggle band 5*b* at its free end, pulls it across his face, and attaches it to the opposite side of the hat as in the previously described embodiments. As this happens, knob 20 slides toward the front of pocket 4*c* toward the wearer's eyes along track 23. Further inward motion of knob 20 is prevented when the knob reaches its most forward position on track 23, which prevents the goggle band from falling out of the pocket. To retract goggle band 5*b* into the pocket, after use, the wearer first detaches the goggle band free end 5*c* from its separable attachment at the opposite side of the hat, and then takes hold of knob 20 with his other hand to slide the knob along track 23 back to its rearmost position in pocket 4*c*, which causes the goggle band to be pulled into its stored position within pocket 4*c*.

Figure 8:
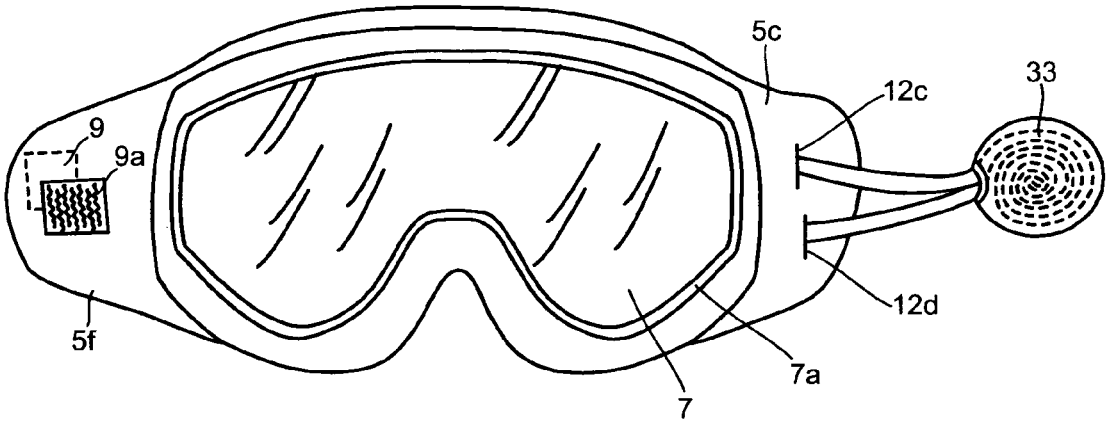
FIG. 8 illustrates an additional embodiment of the invention.

In the embodiment of the invention shown in FIG. 8, a retention mechanism or wire 11 *a* begins at a point 12*c* on goggle band 5*c* and passes through a spring-loaded pull and reel mechanism 33. Wire 11*a* then passes out of reel mechanism 33 and reconnects to goggle band 5*c* at a point 12*d*. The goggle band may also be used in any of the previously described embodiments by attaching reel mechanism 33 to the inside of the storage pocket. In use of the FIG. 8 embodiment, the wearer grabs area 5*f* of goggle band 5*c* and pulls it across his face to the opposite side of the hat. As this is occurring, retention string 11 *a* unwinds from reel mechanism 33 and extends through the pocket.

When the wearer attaches area 5*f* to the opposite side of the hat at Velcro® (hook and loop fabric) tab 14, reel mechanism 33 locks in place and maintains the extended length of string 11 *a* constant. When the wearer no longer wishes the goggle band to be positioned over his eyes, he detaches area 5*f* from Velcro® (hook and loop fabric) tab 14 and pulls area 5*f* out and away from reel mechanism 33, thereby to release the locking mechanism. The wearer then releases his hold on area 5*f*, which causes reel mechanism 33 to automatically recoil and rewind retention string 11*a* back into reel mechanism 33, thereby to pull the goggle band back into the storage pocket.

Figure 9:
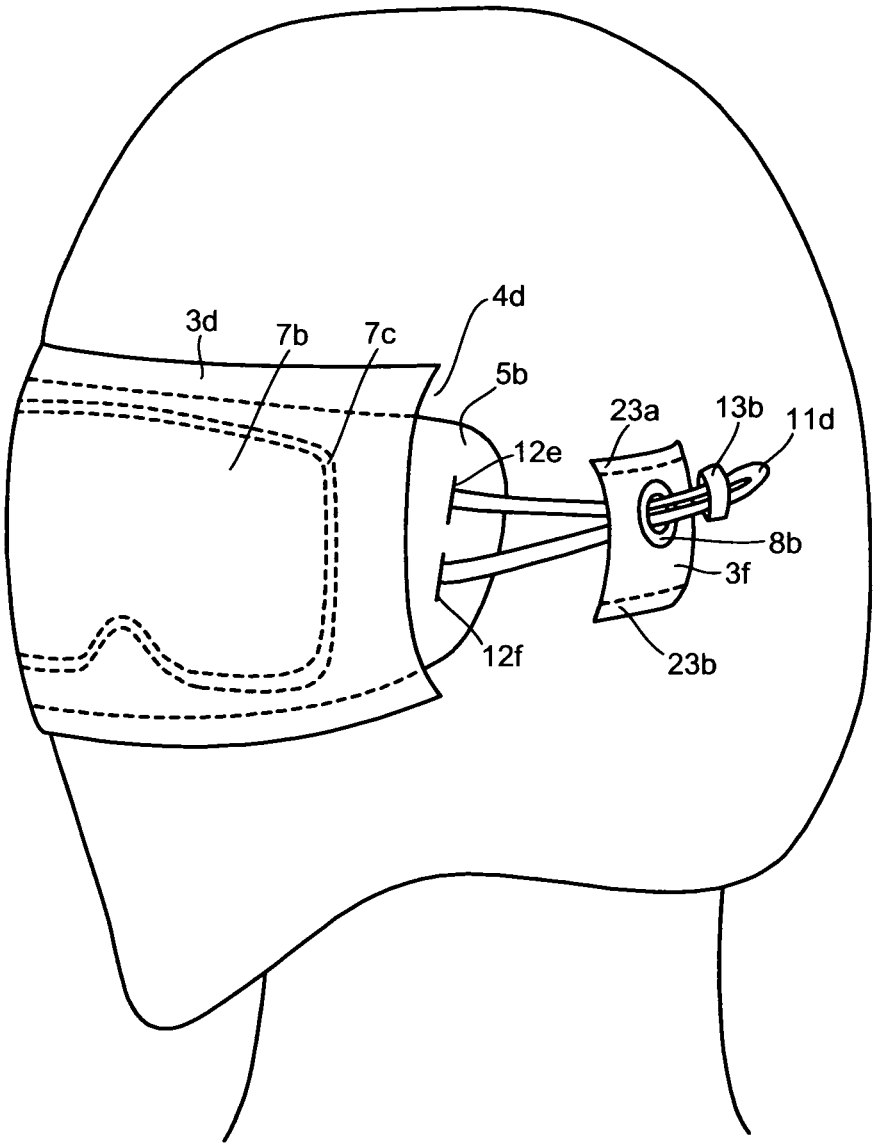
FIG. 9 illustrates yet another embodiment of the invention.

FIG. 9 shows an alternate embodiment to that shown in FIG. 1, with the hat being viewed from the rear. Pocket 4*b* houses goggle band 5*b* by means of material 3*d* attached to hat 3. Goggle band 5*b* protrudes out of pocket 4*d* at the opening at its rear. A string 11*d*, attached to goggle band 5*b* at a point 12*e*, passes through a grommet 8*b* on a separate fabric tab 3*f*. Fabric tab 3*f* is sewn to hat 3 by an upper stitch 23*a* and lower stitch 23*b*. String 11*d* then passes through chord lock 13*b*, loops back around passing through chord lock 13*b*, then through grommet 8*b*, and is reattached to goggle band 5*b* at point 12*f*. By positioning external tab 3*f* at a location further to the rear of hat 3, the wearer is allowed more leverage when he pulls goggle band 5*b* back into pocket 4*b* by means of string 11*d*. The position of tab 3*f* allows goggle band 5*d* to be pulled further back into pocket 4*d*.

As an alternate to string 11*d*, goggle band 5*b* may extend through pocket 4*d* to its rear in the form of a material band, which then may pass through a plastic ring or loop that would be used in place of grommet 8*b*. The excess, extended material from goggle band 5*b* would pass through this loop, change direction toward the front of the hat and be separably be attached by means of a Velcro® (hook and loop fabric) tab, for example, to a designated area at the rear of the pocket. Excess material from goggle band 5*b* would pass through the loop and then through any known adjustable guiding mechanism. This arrangement allows for the lengthening or shortening of the excess material of goggle band 5*b*, thus allowing for an adjustable fit of the goggle band over the wearer's eyes.

Excess, extended material from goggle band 5*b* or from string 11*d* may also pass out of pocket 4*d* at a slit or opening on the surface of material 3*d* at the rear of pocket 4*d*.

It is also possible to incorporate the reel mechanism 33 into the embodiment of FIG. 9 in which the reel mechanism would be placed between tab 3*f* and pocket 4*b*—either attached to hat 3 or left to hang loose. String 11*d*, beginning at point 12*e*, would pass out of pocket 4*b*, then through reel mechanism 33, through grommet 8*b* of tab 3*f* and then through chord lock 13*b*, where it loops around and passes back through grommet 8*b*, through reel mechanism 33, and is reattached to goggle band 5*b* at point 12*f*. Reel mechanism 33 may also be positioned external to tab 3*f* in a similar manner.

It will be understood that although the present invention has been hereinabove described with respect to several embodiments thereof, modifications may be made therein and thereto without necessarily departing from the spirit and scope of the invention as defined in the appended claims.

What is claimed is:

1. Headwear comprising:

a headwear portion having opposite sides; a storage region formed at one side of said headwear portion and having an opening at least one end thereof;

an accessory configured for protecting a portion of a wearer's face, the accessory having first and second opposing ends stored, when not in use, in said storage region in a first position, said first end of said accessory being manually removable from said storage region through said opening;

a movement-limiting means secured to said second end of said accessory for limiting axial movement of said accessory within said storage region, thereby to retain said second end of said accessory within said storage region; and first and second cooperating means respectively secured to said first end of said accessory and the opposite side of said headwear portion for detachably securing said first end of said accessory at a location at the opposite side of said headwear portion after said first end of said accessory has been removed from said storage region and pulled to a second position over the wearer's face.

2. Headwear according to claim 1, in which said headwear portion comprises a ski hat and said accessory comprises a ski goggle.

3. Headwear according to claim 1, wherein said movement-limiting means comprises a retention element having a first end attached to said second end of said accessory, and a second opening at the rear of said storage region through which said retention element passes.

4. Headwear according to claim 3, further comprising locking means engaged to a segment of said retention element external to said storage region.

5. Headwear according to claim 4, wherein said retention element passes out of said storage region and through said locking means.

6. Headwear according to claim 4, wherein said locking means has a configuration such that it cannot pass through said second opening into the interior of said storage region.

7. Headwear according to claim 6, in which said retention element passes through said second opening at the rear of said storage region and through a third opening located at an alternate position on said main headwear.

8. Headwear according to claim 7, wherein said retention element also passes through said locking means.

9. Headwear according to claim 3, in which said retention element is a string.

10. Headwear according to claim 9, in which said string has a second end attached to said second end of said accessory at a location spaced from the point of attachment of said first string end to said accessory, said string engaging said locking means at a portion of said string intermediate its first and second ends.

11. Headwear according to claim 4, in which the position of said locking means relative to said storage region is adjustable, thereby allowing the selective loosening and tightening of said accessory when it is in its second position over the face of the wearer.

12. Headwear according to claim 1, wherein said movement-limiting means comprises a retention element secured to said second end of said accessory and having a dimension greater than that of said first opening of said storage region, whereby said accessory is prevented from being removed from said storage region through said first opening therein.

13. Headwear according to claim 12, in which the horizontal position of said opening is adjustable, thereby to enable the selective loosening and tightening of said accessory when it is in its said second position across the wearer's face.

14. Headwear according to claim 4, in which the location of said locking means relative to said retention element is adjustable, thereby to permit the selective loosening and tightening of said accessory when it is in its said second position across the wearer's face.

15. Headwear according to claim 4, in which said locking means is a pull and reel mechanism.

16. Headwear according to claim 15, in which a second end of said retention element passes through said pull and reel mechanism.

17. Headwear according to claim 1, in which said headwear portion includes therein a layer that is non-permeable to moisture positioned adjacent said storage region for preventing the passage of moisture from the wearer's head through said headwear portion to said accessory when the latter is stored in said storage region.

18. Headwear according to claim 1, in which said first and second cooperating securing means comprise cooperating male and female hook and loop fabric tabs.

19. Headwear according to claim 1, in which said accessory is a bandanna.

20. Headwear according to claim 1, in which said headwear portion is a hood.

21. Headwear according to claim 20, further comprising additional securing means attached to the inner side of said hood.

22. A kit comprising;

Headwear comprising:

a main headwear portion comprising a breathable material that allows passage therethrough of moisture and heat, wherein the main headwear portion is a ski hat;

an accessory-storage region formed in an area of said main headwear portion; and a layer of a material that is substantially non-permeable to moisture secured to said main headwear portion at a location adjacent to said storage region, said layer of non-permeable material serving to substantially prevent moisture from the wearer's head through said headwear portion into said storage region and from reaching an accessory stored therein; and a goggle stored in said storage region of said headwear.

23. Headwear according to claim 1, further comprising means operatively secured to the accessory for manually returning the accessory from the second position to the first position in the storage region after the accessory has been detached from the second position.

24. Headwear according to claim 23, wherein the returning means comprises a string operatively secured to the accessory and extending through the opening when the accessory is in the storage region.

* * * * *